US010872755B2

(12) United States Patent
Christian

(10) Patent No.: US 10,872,755 B2
(45) Date of Patent: Dec. 22, 2020

(54) LOW POWER MASS ANALYZER AND SYSTEM INTEGRATING SAME FOR CHEMICAL ANALYSIS

(71) Applicant: Leidos, Inc., Reston, VA (US)

(72) Inventor: Noah Christian, San Diego, CA (US)

(73) Assignee: Leidos, Inc., Reston, VA (US)

( * ) Notice: Subject to any disclaimer, the term of this patent is extended or adjusted under 35 U.S.C. 154(b) by 0 days.

(21) Appl. No.: 15/462,339

(22) Filed: Mar. 17, 2017

(65) Prior Publication Data

US 2017/0271138 A1 Sep. 21, 2017

Related U.S. Application Data

(60) Provisional application No. 62/309,581, filed on Mar. 17, 2016.

(51) Int. Cl.
*H01J 49/30* (2006.01)
*H01J 49/00* (2006.01)

(52) U.S. Cl.
CPC ..... *H01J 49/30* (2013.01); *H01J 49/0022* (2013.01)

(58) Field of Classification Search
None
See application file for complete search history.

(56) References Cited

U.S. PATENT DOCUMENTS 4,473,748 A * 9/1984 Konagai ..... H01J 49/025 250/299
4,785,172 A * 11/1988 Kubena ..... H01J 37/244 250/288
5,481,110 A * 1/1996 Krishnaswamy ... H01J 49/0018 250/281
6,180,942 B1 * 1/2001 Tracy ..... G01T 1/2928 250/283
7,402,799 B2 7/2008 Freidhoff ..... 250/294
7,649,171 B1 1/2010 Freidhoff ..... 250/281
(Continued)

FOREIGN PATENT DOCUMENTS

GB 1116807 A * 6/1968 ..... H01J 49/30
GB 1116807 A * 6/1968 ..... H01J 49/30

OTHER PUBLICATIONS

Hadjar, et al., "IonCCD™ for Direct Position-Sensitive Charged-Particle Detection: From Electrons and keV Ions to Hyperthermal Biomolecular Ions," Journal of The Americans Society for Mass Spectrometry, vol. 22, Issue 4, pp. 612-613, Apr. 2011.
(Continued)

*Primary Examiner* — Andrew Smyth
(74) *Attorney, Agent, or Firm* — Dawn-Marie Bey; Bey & Cotropia PLLC

(57) ABSTRACT

A low power mass spectrometer (LPMS) includes an ionization source for generating an ionized sample beam; ion focusing optics for focusing the sample beam; and a static magnetic field region contained within an electric field-free drift region created between magnets acting as equipotential electrodes combined with a third equipotential surrounding electrode for receiving the focused sample beam and deflecting ions therein to different points on a detector array in accordance with an individual mass thereof. The LPMS operates at less than 1.2 Watts and has a physical footprint equal to or less than 12 inches at its largest length.

17 Claims, 6 Drawing Sheets

(56) References Cited

U.S. PATENT DOCUMENTS

| | | | | |
|---|---|---|---|---|
| 2006/0011829 | A1* | 1/2006 | Scheidemann | H01J 49/322 250/288 |
| 2013/0344610 | A1* | 12/2013 | Cooks | H01J 49/06 436/141 |
| 2015/0017022 | A1* | 1/2015 | Fomani | H01J 41/12 417/49 |
| 2015/0348770 | A1* | 12/2015 | Hoang | H01J 49/20 250/299 |
| 2016/0086781 | A1* | 3/2016 | Cooks | G01N 33/574 435/5 |
| 2017/0131247 | A1* | 5/2017 | Gazis | G01N 30/8617 |

OTHER PUBLICATIONS

Hadjar, et al., "Preliminary Demonstration of an IonCCD™ as an Alternative Pixelated Anode for Direct MCP Readout in a Compact MS-Based Detector," Journal of The American Society for Mass Spectrometry, vol. 23, pp. 418-424, 2012.

Barnes, J. H., Hieftje, G. M., "Recent Advances in Detector-Array Technology for Mass Spectrometry," Int. J. Mass Spectrom., 238, pp. 33-46 (2004).

Schilling, G. D., et al., "Detection of Positive and Negative Ions From a Flowing Atmospheric Pressure Afterglow Using a Mattauch-Herzog Mass Spectrograph Equipped With a Faraday-Strip Array Detector," J. Am. Soc. Mass Spectrom., 21, pp. 97-103, 2010.

Solyom, D. A., Hieftje, G. M., "Simultaneous or Scanning Data Acquisition? A Theoretical Comparison Relevant to Inductively Coupled Plasma Sector-Field Mass Spectrometers," J. Am. Soc. Mass Spectrom., 14, Issue 3, pp. 227-235, 2003.

J. P. Hauschild, et al., "Mass Spectra Measured by a Fully Integrated MEMS Mass Spectrometer," International Journal of Mass Spectrometry, 264, pp. 53-60, 2007.

"Focus on Field-Portable and Miniature Mass Spectrometers," Presentations From the 12th Sanibel Conference on Mass Spectrometry, J. Am. Soc. Mass Spectrom., 12, pp. 617-618, 2001.

Mo Yang, et al., "Development of a Palm Portable Mass Spectrometer," J. Am. Soc. Mass Spectrom., 19, pp. 1442-1448, 2008.

J. Mitchell Wells, et al., "Implementation of DART and DESI Ionization on a Fieldable Mass Spectrometer," J. Am. Soc. Mass Spectrom., 19, pp. 1419-1424, 2008.

Jorge Andres Diaz, et al., "Test of a Miniature Double-Focusing Mass Spectrometer for Real-Time Plasma Monitoring," Trends in Analytical Chemistry, vol. 21, No. 8, pp. 515-525, 2002.

Guangming Huang, et al., "Direct Detection of Benzene, Toluene, and Ethylbenzene at Trace Levels in Ambient Air by Atmospheric Pressure Chemical Ionization Using a Handheld Mass Spectrometer," J. Am. Soc. Mass Spectrom., 21, pp. 132-135, 2010.

Gregory D. Schilling, "Detection of Positive and Negative Ions From a Flowing Atmospheric Pressure Afterglow Using a Mattauch-Herzog Mass Spectrograph Equipped With a Faraday-Strip Array Detector," J. Am. Soc. Mass Spectrom., 21, pp. 97-103, 2010.

David A. Solyom, et al., "Simultaneous or Scanning Data Acquisition? A Theoretical Comparison Relevant to Inductively Coupled Plasma Sector-Field Mass Spectrometers," J. Am. Soc. Mass Spectrom., 14, pp. 227-235, 2003.

Jesse A. Contreras, et al., "Hand-Portable Gas Chromatograph-Toroidal Ion Tap Mass Spectrometer (GC-TMS) for Detection of Hazardous Compounds," J. Am. Soc. Mass Spectrom., 19, pp. 1425-1434, 2008.

Li Ding, et al., "A Simulation Study of the Digital Ion Trap Mass Spectrometer," International Journal of Mass Spectrometry, 221, pp. 117-138, 2002.

Jorge Andres Diaz, et al., Integration Test of a Miniature ExB Mass Spectrometer With a Gas Chromatograph for Development of a Low-Cost, Portable, Chemical-Detection System, Trends in Analytical Chemistry, vol. 23, No. 4, pp. 314-321, 2004.

Timothy P. Griffin, et al., "Three-Dimensional Concentration Mapping of Gases Using a Portable Mass Spectrometer System," J. Am. Soc. Mass Spectrom., 19, pp. 1411-1418, 2008.

Peter T. Palmer, et al., "Mass Spectrometry in the U.S. Space Program: Past, Present, and Future," J. Am. Soc. Mass Spectrom., 12, pp. 656-675, 2001.

* cited by examiner

LOW POWER MASS ANALYZER AND SYSTEM INTEGRATING SAME FOR CHEMICAL ANALYSIS

CROSS REFERENCE TO RELATED APPLICATIONS

The present application claims benefit of priority to U.S. Provisional Patent Application No. 62/309,581, entitled "Zero Power Mass Analyzer," filed Mar. 17, 2016, the entirety of which is incorporated herein by reference.

BACKGROUND

Field of the Embodiments

The embodiments are directed to a very low power mass spectrometer (LPMS), with a zero-power mass analyzer, that is capable of high performance in a small form factor. Additional embodiments include chemical detection systems incorporating components and features of the LPMS.

Description of the Related Art

J. J. Thomson invented the first mass spectrometer in 1913, in 1932 Joseph Mattauch and Richard Herzog invented the double-focusing mass spectrograph, and in 1940 Alfred Nier made a single-focusing mass spectrometer using a 60-degree magnetic sector. Mass spectrographs have existed in variants to the Mattauch-Herzog and Nier-Johnson geometries, but there has been little to no development direct to making a small, compact, low-power arrayed instrument.

The increasing use of improvised explosives, the ever-expanding contraband threat matrix, and the complications that interferents and obscurants pose to detecting these materials has created a need for improved threat detection in the field. Current detectors that use ion mobility spectrometry (IMS) suffer from limited resolution, inevitably leading to increased false alarms as the complexity of samples increases. Large mass spectrometers are gold-standard detectors for explosives and narcotics in the laboratory. There has been considerable effort to reduce these instruments to a handheld system, but there are still unresolved challenges.

Detection time can be limited, because typical designs for portable devices function as a mass filter, capable of measuring only one mass at a time. These systems have a single channel detector and require sweeping through all masses over time. In this process, transient species may be missed. IMS systems are limited due to the need to pulse ions and then measure ion arrival times, and similarly cannot detect all ions simultaneously in a dispersive manner. Some threats tend to form positive ions and others negative ions. This requires switching polarities in the IMS or MS system, further limiting potential sensitivity and throughput. In analyzers, such as time-of-flight instruments, high voltage is usually generated by converting direct current (DC) to an alternating current (AC) voltage, sending it through a voltage multiplier or step-up transformer, and then rectifying the AC voltage to generate DC. This results in corresponding efficiencies as low as 10%.

Further, radio frequency (RF) generation is required for many mass-to-charge traps and filters, such as rectilinear or curvilinear ion traps, quadrupole mass filters, differential mobility spectrometers, and ion funnels. Generally, the capacitance of the quadrupole or trap can lead to small theoretical power consumption values, though in practice the switching electronics play a dominant role in the power consumption of the system. For example, a 4-MHz frequency on an ion trap or quadrupole with a trap capacitance of 0.1 pF requiring a 400 V switching voltage will require 0.8e-8 J/cycle or 32 μW. However, when one considers that, in order to switch this voltage, a 500V transistor with a drain to source capacitance of 1,000 pF (Ciss or Cgs+Cgd) is required, the switching charge per cycle increases to 0.48e-6 J/cycle and the true power consumption rises by over three orders of magnitude to 1.92 W.

A significant challenge to a small MS or IMS is the associated size, weight, power, and durability (shock and vibration) limitations associated with the required vacuum system. Most IMS detectors have a sample flow into the inlet and a countercurrent flow in the ion mobility drift cell. These require pumps that have issues with off-gassing (potentially limiting cleardown times), and significant power consumption. Mass spectrometers require even more elaborate pumping systems and rely on higher power (and typically lower durability) pumping systems to achieve their high-vacuum requirements. These factors limit the use of conventional MS for portable explosive trace detectors in handheld environments, e.g., airport security and the like.

Accordingly, high power consumption remains a limitation to development of an effective handheld mass spectrometry device or a small footprint device that may be incorporated into a portable modular system. There remains a need in the art for a reduced footprint, reduced power mass spectrometer.

SUMMARY OF EMBODIMENTS

In a first exemplary embodiment, a low power mass spectrometer for facilitating analysis of a sample's chemical contents includes: an ion focusing component for focusing a sample ion beam containing sample ions to a focal point; a magnet assembly for creating a permanent magnetic field region beginning at the focal point of the ion focusing component for deflecting the focused sample ions using zero power; and a detector array for detecting the deflected sample ions, wherein the detector array lies in the same plane as the focal point of the ion focusing component and further wherein individual sample ions are deflected to different points along the detector array in accordance with an individual mass thereof.

In a second exemplary embodiment, a zero-power mass analyzer for facilitating analysis of a sample's chemical contents includes: a magnet assembly for creating a permanent magnetic field region beginning at a focal point of an ion focusing component for deflecting focused sample ions using zero power to a detector, wherein individual sample ions are deflected to different points along the detector in accordance with an individual mass thereof.

In a third exemplary embodiment, a low power mass spectrometer for facilitating analysis of a sample's chemical contents includes: an ionization source for ionizing the sample to form an ion beam containing sample ions; an ion focusing component for focusing the sample ion beam to a focal point; a permanent magnetic field region beginning at the focal point of the ion focusing component for deflecting the focused sample ions; at least one vacuum pump for maintaining a predetermined vacuum pressure in the permanent magnetic field region; and a detector array for detecting the deflected sample ions, wherein the detector array lies in the same plane as the focal point of the ion focusing component and further wherein individual sample ions are deflected to different points along the detector array in accordance with an individual mass thereof.

BRIEF DESCRIPTION OF THE FIGURES

The following Figures are to be considered in conjunction with the detailed description below.

DETAILED DESCRIPTION

The embodiments described herein exploit the same physical behavior of ions moving in a magnetic field as other magnetic sector geometries. However, current beam-type systems use the magnetic field as an external lens to focus or defocus ions to accomplish ion separation. The principle of operation relied on in the current embodiments applies a static magnetic field to spatially separate ions of different masses without performing work on the ion. The use of permanent magnetic fields permits an entirely passive mass analyzer that separates ions with no power. The shortened ion flight path, i.e., reduced to centimeters as compared to meters for kilometers, afforded by the 180-degree sector instrument reduces the vacuum requirements. Furthermore, the use of a detector array allows the source ions to flow continuously to the detector and enables the parallel detection of all ion mass to charge ratios, effectively eliminating the requirement for scanning of electric or magnetic fields. Angular or velocity distributions are corrected by lens elements outside of the magnetic field as the ion packet enters the field. The incoming ion beam is focused to a narrow region at the entrance to the magnetic field. Neither the source nor the detector needs to be pulsed in any way, reducing power requirements and eliminating the inherent loss of ion signal due to pulsing inlets and filtering or scanning masses. This should enable part-per-trillion (ppt) sensitivity, comparable to benchtop mass spectrometers. Simulations and experiment show that the angular distribution of ions is exactly compensated by a half turn of the ion trajectory (180 degrees or Pi radians), leading to a sharply focused array of ions at a linear detector.

The current embodiments compensate for angular dispersion by the compensating mechanism of the magnetic field, and spatial dispersion by adjusting trajectories in the entry zone of the magnetic field. The magnetic field acts as a mirror, and ion packets that are focused on the inlet are refocused on the outlet. This contrasts with other higher order focusing schemes that utilize the magnet as a lens where the focused ion packet occurs outside of the lens. This makes the current geometry very compact when compared to other systems. Further, because the ion trajectory is fairly short, ultra-high vacuum is not required. The present invention is amenable to a compact, handheld mass spectrometer.

Figure 1:
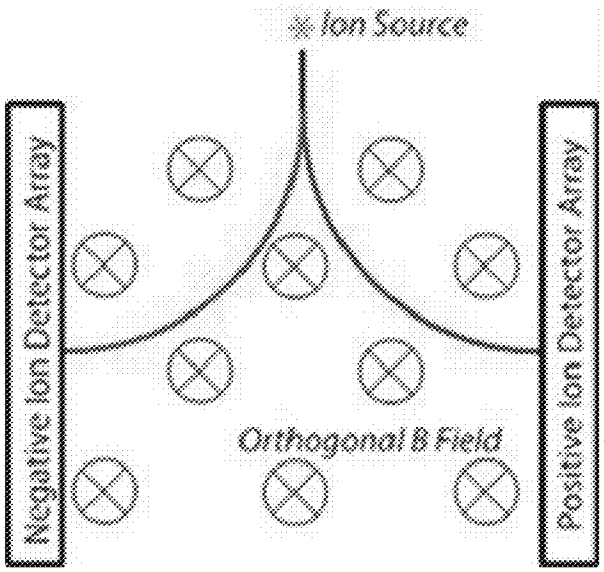
FIG. 1 is a schematic of a mass spectrometer with simultaneous positive and negative ion detection.

A basic conceptual approach to the mass analyzer and detector portions are shown in FIG. 1. This approach follows the very earliest mass spectrometer design, which permits the measurement of all m/z of positive and negative ions at once. In a preferred embodiment as discussed herein, a single ionization polarity is created and sent to the magnetic field. This is because nearly all typical ionization sources are unipolar. An ionization source may switch polarity, in our preferred embodiment we use one detector. Two detectors and a single switched unipolar ionization source could be used, as shown in FIG. 1, or one detector with two unipolar ionization sources could be used. For simplicity, we discuss a single, unipolar, ionization source creating ions that are sent to a single detector.

Figure 2A:
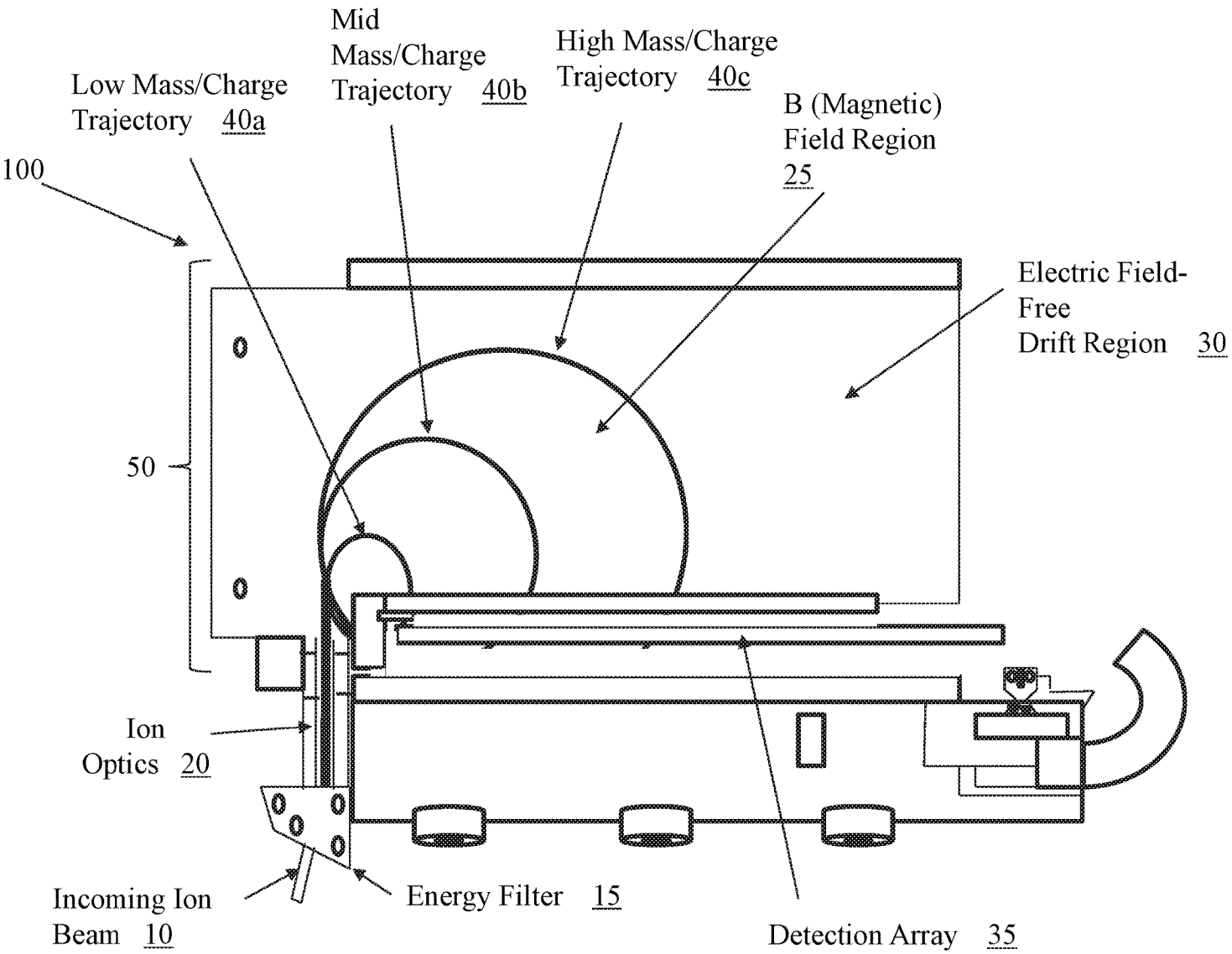
FIGS. 2*a* to 2*c* are conceptual renderings of a low power mass spectrometer (LPMS) in accordance with a preferred embodiment.
Figure 2B:
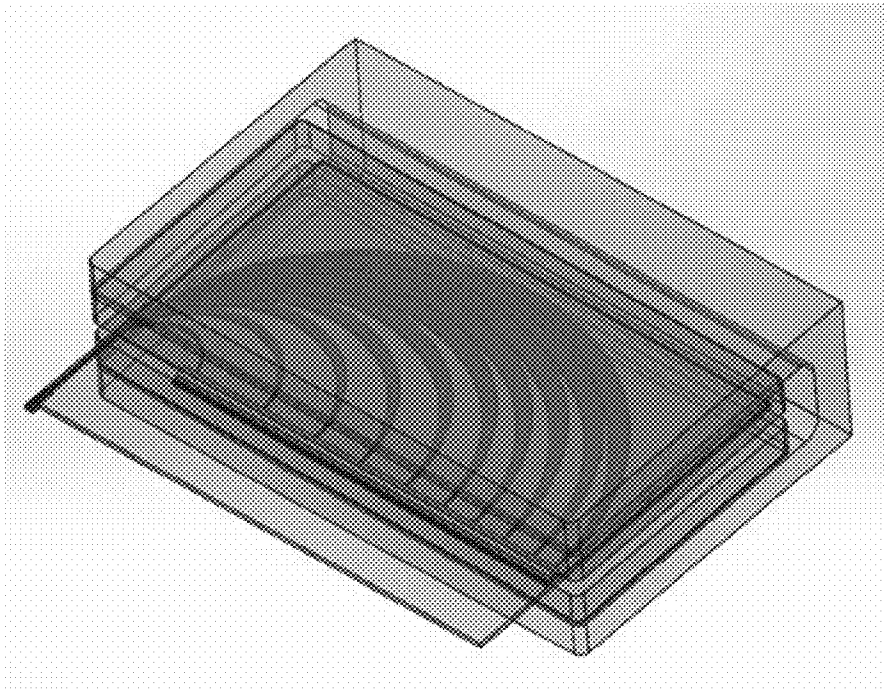
Figure 2C:
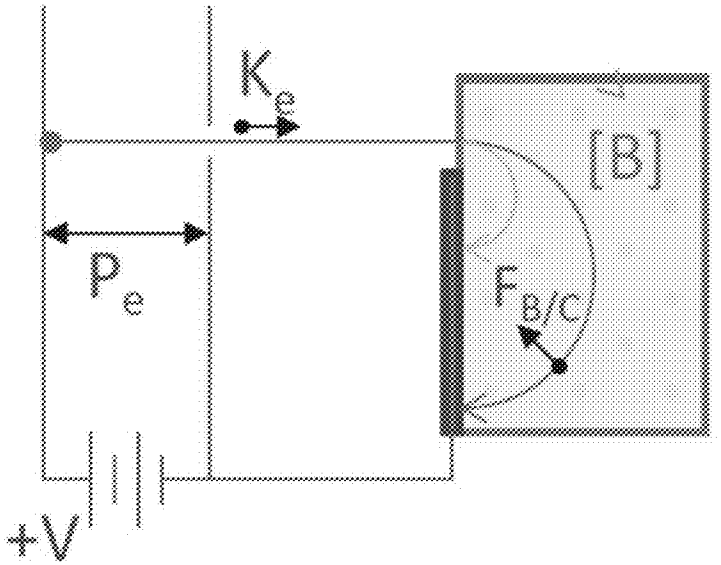

A 180-degree, or π-d geometry (π radians with d diameter) analyzer is preferred because the maximum mass resolution and mass span in minimal space is accomplished through a 180-degree sector instrument depicted variously in FIGS. 2*a* through 2*c*.

FIG. 2*a* is illustrative of various components and functional relationships of a LPMS 100 in accordance with a preferred embodiment. The LPMS includes input for an incoming ion beam that has been generated by an ionization source such as an electron impact ionization, photoionization, or chemical ionization source and enters at 10; an energy filter 15 which accomplishes energy filtering to a narrow energy range via balancing a radial electric field with centripetal acceleration (typically referred to as an electrostatic analyzer or electrostatic energy filter), ion focusing optics 20, a static magnetic field region 25, contained within an electric field-free drift region created between magnets acting as equipotential electrodes combined with a third equipotential surrounding electrode 30 and detector array 35. The magnets and resulting magnetic field region is housed within a vacuum chamber 50 which may be formed of metallized plastic or other suitable materials to meet weight and durability requirements. Exemplary ion trajectories 40*a*, 40*b* and 40*c* are indicated to exemplify trajectories for low mass/charge ions 40*a*, mid mass/charge ions 40*b*, and high mass/charge ions 40*c*. FIG. 2*b* provides an alternative view of the exemplary LPMS.

A reduced footprint low power mass spectrometer (LPMS) described herein may be incorporated in a number of devices and systems used to detect and analyze numerous chemicals. For example, in a first embodiment, a handheld device incorporating a LPMS described herein is useful for screening of cargo, baggage, and passengers to ensure transportation security. Such devices are also highly useful to first responders, facility protection, Customs and Border Protection, and the Coast Guard. The approach disclosed in the present embodiments may be implemented in point of care diagnostics, small portable breath analyzers for significant biomarkers (diabetes, metabolic disorders, cancers, etc.), building monitors, and chemical detectors for mine safety. The handheld device incorporating a LPMS provides a portable explosive threat detection (PETD) device. As discussed in detail herein, the key features of the LPMS include: 1) better than 0.2 amu mass accuracy; 2) low power usage (e.g., microwatts in operation); 3) continuous and simultaneous detection of threat masses over time on a focal plane array (without the need for scanning voltages, scanning magnet fields, using radio frequency waveforms, or synchronizing ion pulses); 4) small size scaled by the size and dimensions of the detector array; and 5) high-dynamic range ($10^5$-$10^6$).

The embodied device operates similar to a shutter less camera sensor, continually integrating all ions in the system and changing integration times to react to high concentrations of threat compounds. Due to the nature of ion collection, the embodied device is significantly better than other mass spectrometric systems at capturing transient species and exhibits high sensitivity for trace components. This analyzer is highly immune to electromagnetic interference (EMI), shock, and vibration.

An exemplary device includes a Micro Electromechanical System (MEMS) pumping system which eliminates the need for a turbo pump or conventional mechanical pump, improves power efficiency (requiring less than a watt total for operation), lowers production cost, lengthens product lifetime (no sliding seals or consumable surfaces), improves systems compatibility and cleardown (due to an inert flow path and lack of elastomeric seals), and enables ultra-quiet operation. Very low-power, low-mass, high-reliability MEMS pumps generate the sample inlet flow and vacuum for the system. This approach capitalizes on technology developed for micro-fabricated pump elements, including electrostatic zipper pumps, micro-fabricated valves (e.g., piezoelectric), and electro-hydrodynamic ion streaming pumps. In addition to improved power efficiency, other benefits of the design approach include robustness, low-noise signature, immunity to vibration and shock, flow rates compatible with atmospheric pressure mass spectrometer inlets, low susceptibility to electromagnetic interference (EMI) and projected low cost in production quantities. In a preferred embodiment, the pump weight is less than half a pound and highly immune to shock and vibration. In preferred embodiments, the only moving parts of the LPMS are the MEMS components and the durability will be comparable to a solid-state hard drive.

Accordingly, in a preferred embodiment, the LPMS includes a static magnetic sector mass analyzer with a charge-coupled device (CCD) array detector and highly efficient MEMS pumps to generate the vacuum environment and control the sample inlet. These changes to the analyzer, detector, and vacuum system of the LPMS as compared to existing mass spectrometry devices significantly impact the overall performance of the embodied LPMS and incorporating system.

Referring to the schematic of FIG. 2*c* a representative mathematical model and ion trajectories for a preferred 180-degree turn magnetic analyzer are described below. In this model, ions are sent with an acceleration voltage V into a magnetic field, and follow a semicircular trajectory into a detector array. The model system used a 1 Tesla magnet and 100 Volts of acceleration potential and a linear detector array with a 51 mm×1.5 mm active area. The collector pixels are TiN targets of approximately 21 micrometers by 1.5 millimeters spaced by a 3 micrometer gap. The full turn allows for maximal mass separation, at the expense of a potentially larger magnet size. A smaller path, such as 90 degrees or 45 degrees is equally possible, would have a shorter ion trajectory, smaller physical size, and could be evacuated with less demanding vacuum pumping technologies. Trades include the mass range, resolution, system size, ion trajectory (simplicity vs. compensating higher order errors), and sensitivity. Table 1 presents example detector sizes and mass spacing at the closer spaced high mass range for different acceleration potentials. For optimal resolution, the detector array in the representative embodiment is sized to the 313 V acceleration potential, as this spaces each mass by approximately three pixels (24 um pixel pitch). The detector would be able to simultaneously detect all masses from 100 to 400 Da.

TABLE 1

| Acceleration Voltage | Size of Detector | Distance per Da (at 400) |
|---|---|---|
| 12 V | 1.0 cm | 12.5 μm |
| 100 V | 2.8 cm | 36.0 μm |
| 313 V | 5.1 cm | 63.7 μm |

For the model describe above, the first derivation determines the radius of curvature of an ion in a magnetic field based on initial velocity. A charged particle moving through a magnetic field induces a force ($F_b$) equivalent to the centripetal force ($F_c$). While this is a generalizable solution, it can be applied to the case in the figure below, where ions of all mass to charge ratios are accelerated in an electrostatic field to a constant kinetic energy ($K_e$) set by a voltage (+V) between two electrodes. One skilled in the art understands that other sources could potentially give uniform velocities and would have different final trajectory calculations. Starting with the equation for force on a moving particle in a magnetic field:

restart:with(RealDomain):$eq1 := F_B = v \cdot z \cdot B$ where v is the velocity, z is the charge, and B is the magnetic field strength. The magnetic force exerts centripetal force on the ion, given by the relation:

$$eq2 := F_c = \frac{m \cdot v^2}{r}$$

where m is the mass of the ion and r is the radius of curvature. Setting these equal and solving gives the relationship of radius, mass, and charge of an ion in a magnetic field.

$$eq3 := F_B = F_C$$

$$\text{solve}(\{eq1, eq2, eq3\})$$

$$\{B = B, m = m, r = r, v = 0, z = z, F_B = 0, F_c = 0\},$$

$$\left\{B = B, m = \frac{zBr}{v}, r = r, v = v, z = z, F_B = vzB, F_c = vzB\right\}$$

$$eq4 := \%[2, 2]$$

$$m = \frac{zBr}{v}$$

To determine the initial velocity of an ion going into the magnetic field given a constant electrostatic accelerating field, the relations of potential energy of a charged particle in an electric field ($P_e$) is related to the final kinetic energy of the ion ($K_e$). In the potential energy calculations, V is the applied voltage on an electrode.

$$eq5 := P_e = z \cdot \mathrm{V}$$

$$eq6 := K_e = \frac{1}{2} \cdot m \cdot v^2$$

$$eq7 := P_e = K_e$$

$$\text{solve}(\{eq5, eq6, eq7\})$$

$$\left\{V = \frac{1}{2}\frac{mv^2}{z}, m = m, v = v, z = z, K_e = \frac{1}{2}mv^2, P_e = \frac{1}{2}mv^2\right\}$$

$$eq8 := \%[1]$$

-continued $$V = \frac{1}{2}\frac{mv^2}{z}$$

The above equation relates mass to charge ratio, applied voltage, and resulting velocity. Solving for v in Equation 8 and substituting into Equation 4 gives the curvature of a given ion in a magnetic field under constant (DC) acceleration.

solve($eq8$, $v$)

$$\frac{\sqrt{2}\sqrt{mVz}}{m}, -\frac{\sqrt{2}\sqrt{mVz}}{m}$$

The mathematical expression above considers both positive and negative masses. For simplicity, we assume only positive mass and positive charge (positive ions only, negative ions will have an equal and opposite radial trajectory).

assume($0 < m$, $0 < z$):
solve($eq8$, $v$)

$$\frac{\sqrt{2}\sqrt{z\sim}\sqrt{\mathrm{V}}}{\sqrt{m\sim}}, -\frac{\sqrt{2}\sqrt{z\sim}\sqrt{\mathrm{V}}}{\sqrt{m\sim}}$$

simplify(% [1])

$$\frac{\sqrt{2}\sqrt{z\sim}\sqrt{\mathrm{V}}}{\sqrt{m\sim}}$$

$$eq9 := v = sqrt\left(\frac{2\cdot z\cdot \mathrm{V}}{m}\right) \quad v = \sqrt{2}\sqrt{\frac{z\sim \mathrm{V}}{m\sim}}$$

solve({$eq4$, $eq9$})

$$\left\{B = B, \mathrm{V} = \frac{1}{2}\frac{z\sim B^2 r^2}{m\sim}, m\sim = m\sim, r = r, v = \frac{z\sim\sqrt{B^2 r^2}}{m\sim}, z\sim = z\sim\right\}$$

$$eq10 := \%[2] \quad \mathrm{V} = \frac{1}{2}\frac{z\sim B^2 r^2}{m\sim}$$

solve($eq10$, $r$)

$$\frac{\sqrt{2}\sqrt{m\sim}\sqrt{\mathrm{V}}}{\sqrt{z\sim}\,B}, -\frac{\sqrt{2}\sqrt{m\sim}\sqrt{\mathrm{V}}}{\sqrt{z\sim}\,B}$$

For the mathematical solution, the square of negative and positive radii are both valid. We just take the positive radius for simplicity.

$$eq11 := r = \%[1] \quad r = \frac{\sqrt{2}\sqrt{m\sim}\sqrt{\mathrm{V}}}{\sqrt{z\sim}\,B}$$

Physical constants include: elementary charge, $e=1.6021767\times10^{-19}$ C; mass of proton, $m_p=1.672622\times10^{-27}$ kg; mass of electron, $m_e=9.11\times10^{-31}$ kg; and Avogadro's number, $N_A=6.023\times10^{23}$ mol$^{-1}$ $$e := 1.6021767e-19[\![\mathrm{C.}]\!]$$

$$m_p := 1.672622e-27[\![\mathrm{kg}]\!]$$

$$m_e := 9.11e-31[\![\mathrm{kg}]\!]$$

$$N_A := \frac{6.023e23}{[\![\mathrm{mol}]\!]}$$

Regarding the instrument conditions and mass range, using a mass range of 100 Da to 399 Da (test mass for resolution), and 400 Da (Daltons; 1 g/mol)

$$m_1 := \frac{100\left[\!\left[\frac{\mathrm{g}}{\mathrm{mol}}\right]\!\right]}{N_A} \quad 1.660302175\ 10^{-25}\left[\!\left[\frac{\mathrm{kg}}{\mathrm{mol}}\right]\!\right][\![\mathrm{mol}]\!]$$

$$m_2 := 399\frac{\left[\!\left[\frac{\mathrm{g}}{\mathrm{mol}}\right]\!\right]}{N_A} \quad 6.624605678\ 10^{-25}\left[\!\left[\frac{\mathrm{kg}}{\mathrm{mol}}\right]\!\right][\![\mathrm{mol}]\!]$$

$$m_3 := \frac{400\left[\!\left[\frac{\mathrm{g}}{\mathrm{mol}}\right]\!\right]}{N_A} \quad 6.641208700\ 10^{-25}\left[\!\left[\frac{\mathrm{kg}}{\mathrm{mol}}\right]\!\right][\![\mathrm{mol}]\!]$$

$$\mathrm{V} := 100[\![\mathrm{V}]\!] \quad 100[\![\mathrm{V}]\!]$$

$$B := 1[\![\mathrm{T}]\!] \quad [\![\mathrm{T}]\!]$$

Singly charged ions so the mass to charge ratio is the mass of the ion over charge of one electron:

$$mcr_1 := \frac{m_1}{e} \quad \frac{0.000001036279066\left[\!\left[\frac{\mathrm{kg}}{\mathrm{mol}}\right]\!\right][\![\mathrm{mol}]\!]}{[\![\mathrm{C.}]\!]}$$

$$mcr_2 := \frac{m_2}{e} \quad \frac{0.000004134753475\left[\!\left[\frac{\mathrm{kg}}{\mathrm{mol}}\right]\!\right][\![\mathrm{mol}]\!]}{[\![\mathrm{C.}]\!]}$$

$$mcr_3 := \frac{m_3}{e} \quad \frac{0.000004145116266\left[\!\left[\frac{\mathrm{kg}}{\mathrm{mol}}\right]\!\right][\![\mathrm{mol}]\!]}{[\![\mathrm{C.}]\!]}$$

$$r_1 := \frac{sqrt(2\cdot mcr_1\cdot \mathrm{V})}{B} \quad \frac{0.01439638195\sqrt{\frac{\left[\!\left[\frac{\mathrm{kg}}{\mathrm{mol}}\right]\!\right][\![\mathrm{mol}]\!][\![\mathrm{V}]\!]}{[\![\mathrm{C.}]\!]}}}{[\![\mathrm{T}]\!]}$$

$$r_2 := \frac{sqrt(2\cdot mcr_2\cdot \mathrm{V})}{B} \quad \frac{0.02875675042\sqrt{\frac{\left[\!\left[\frac{\mathrm{kg}}{\mathrm{mol}}\right]\!\right][\![\mathrm{mol}]\!][\![\mathrm{V}]\!]}{[\![\mathrm{C.}]\!]}}}{[\![\mathrm{T}]\!]}$$

$$r_3 := \frac{sqrt(2\cdot mcr_3\cdot \mathrm{V})}{B} \quad \frac{0.02879276390\sqrt{\frac{\left[\!\left[\frac{\mathrm{kg}}{\mathrm{mol}}\right]\!\right][\![\mathrm{mol}]\!][\![\mathrm{V}]\!]}{[\![\mathrm{C.}]\!]}}}{[\![\mathrm{T}]\!]}$$

-continued

| | |
|---|---|
| simplify($r_1$) | 0.01439638195[[m]] |
| simplify($r_2$) | 0.02875675042[[m]] |
| simplify($r_3$) | 0.02879276390[[m]] |

From the above calculations, we see the range from 100-400 Da will have a radius ranging from 0.14 cm to 2.8 cm. To maximize resolution, a 180 degree turn as depicted in the FIG. 3 will give the maximum spatial separation for a given input ion collection. This will be references as a π-d detector where the angle taken is π radians and the separation of ions is twice the radius (d or the diameter).

simplify($2\cdot(r_3-r_1)$)

0.02879276390 [[m]]

simplify($2\cdot r_1$)

0.02879276390 [[m]]

simplify($r_3-r_2$))

0.00003601348 [[m]]

This mass range would be adequately covered on a detector of about 2.8 cm in length with an acceleration of 100 V and a reasonable (1 T) magnetic field. The start of the detector would be about 2.8 cm away from the ion entrance. At the closer m/z spaced high mass range, each Da would be separated by 36 micrometers.

Using a potential of 313 V (high resolution, large analyzer size, scaled to commercial ion detector):

$$V := 313[[V]];\quad r_1 := \frac{sqrt(2\cdot mcr_1\cdot V)}{B};\quad r_2 := \frac{sqrt(2\cdot mcr_2\cdot V)}{B};$$

$$r_3 := \frac{sqrt(2\cdot mcr_3\cdot V)}{B};$$

$$simplify(2\cdot(r_3-r_1));\quad simplify(2\cdot r_1);\quad simplify(r_3-r_2)\ 313[[V]]$$

$$0.05093959936[[m]]\quad 0.05093959934[[m]]\quad 0.00006371434[[m]]$$

Using a potential of 12 V (small analyzer size):

$$V := 12[[V]];\quad r_1 := \frac{sqrt(2\cdot mcr_1\cdot V)}{B};\quad r_2 := \frac{sqrt(2\cdot mcr_2\cdot V)}{B};$$

$$r_3 := \frac{sqrt(2\cdot mcr_3\cdot V)}{B};$$

$$simplify(2\cdot(r_3-r_1));\quad simplify(2\cdot r_1);\quad simplify(r_3-r_2)\ 12[[V]]$$

$$0.009974105998[[m]]\ 0.009974105992[[m]]\ 0.000012475435[[m]]$$

Further, a representative quantitative model for detection efficiency has been calculated based on performance specifications of an exemplary Ion charge-coupled device (CCD) planar arrayed detector used in the embodied device. Specifically, an exemplary CCD ion detector array which may be used in the embodied device is described in the articles "IonCCD™ for Direct Position-Sensitive Charged-Particle Detection: from Electrons and keV Ions to Hyperthermal Biomolecular Ions" by Hadjar et al. published in Journal of The American Society for Mass Spectrometry, April 2011, Vol. 22, Issue 4, pp. 612-623 (hereafter "Hadjar I") and "Preliminary Demonstration of an IonCCD as an Alternative Pixelated Anode for Direct MCP Readout in a Compact MS-Based Detector" by Hadjar et al. published in Journal of The American Society for Mass Spectrometry, 2012, Vol. 23, pp. 481-424, which are incorporated herein by reference in their entirety.

The modeling takes the minimum detectable current at the detector (yielding an SNR of 3) and relates this to flux of ions detected, convoluted with the detector, transmission, and ionization efficiencies. Converting this to moles gives the detection sensitivity per second. The starting values are taken from Hadjar I which has been incorporated herein by reference.

Inputs include: $Q_E$ is detector quantum efficiency; $T_E$ is the transmission efficiency in the instrument; $I_E$ is the ionization efficiency and $N_f$ is the noise floor in fA/pixel. $N_{eff}$ is the effective noise floor, referred to as the input flux of ions in A.

restart:$Q_E$:=0.25

$T_E$:=0.25

$I_E$:=0.01

$N_f$:=0.7 [[fA]]

$eq1$:=$Q_E\cdot T_E\cdot I_E\cdot N_{eff}$=$N_f$ 0.000625$N_{eff}$=0.7 [[fA]]

$N_{eff}$:=solve (%,$N_{eff}$)

1120·[[fA]]

This is the effective limit of detection (LOD) at the input of the source region given the inefficiencies of transmission along the system path. This value is in C/s and represents the charge detection per second. By using the physical constant of charge in C per electron, assuming all singly charged ion species yields the sensitivity in molecules per second:

$$e := 1.6021767e-19[[C.]]$$

$$LOD := simplify\left(\frac{N_{eff}}{e}\right)$$

$$6.990489875\ 10^{6}\left[\left[\frac{1}{s}\right]\right]$$

The system in theory would be capable of detecting the above number of molecules per second, or relating this to moles per second using Avogadro's constant yields:

$$N_A := 6.023E23\left[\left[\frac{1}{mol}\right]\right]\qquad 6.023\ 10^{23}\left[\left[\frac{1}{mol}\right]\right]$$

$$simplify\left(\frac{LOD}{N_A}\right)\qquad 1.160632554\ 10^{-17}\left[\left[\frac{mol}{s}\right]\right]$$

or 11.5 attomoles/second.

The detection efficiency is a limiting factor as there is no ion amplification process, such as a conversion dynode or electron multiplier. Consequently, the detection efficiency is limited by the conversion efficiency (quantum efficiency) and readout efficiency (amplifier and digitization noise). The exemplary detector is reported to have a dynamic range of $10^5$-$10^6$. Detection efficiencies are reported to be identical for ion energies of 15 eV up to 1.5 keV. The quantum efficiency is reported to be 3-4 charges per indicated charge on the detector. And the calculated minimum detectable flux of ions at the source is 11.5 attomoles/second as shown above. Chemical noise is typically several orders of magnitude higher than the electronic noise at the detector, so it is expected to be in the range of 10 fmol/sec at the limit of detection (LOD). For a 400 Da ion, this equates to 4 picograms/second. Thus, for example, a 1 millisecond detector integration time would yield a minimum detectable signal of 4 ng, whereas 10 milliseconds would yield 0.4 ng. The detector array described herein was selected for its detection range, particularly low energy ions of a few election volts (eV). One skilled in the art understands that other CCD ion detectors, CMOS detectors and the like may also be incorporated into the device in accordance with the requirements set forth herein. Additionally, if sensitivity needs to be bolstered, amplification schemes may be incorporated into the LPMS such as intensified microchannel plate detectors, into the system with some post-acceleration to boost ion energies to the threshold of microchannel plate secondary electron emission.

Figure 3:
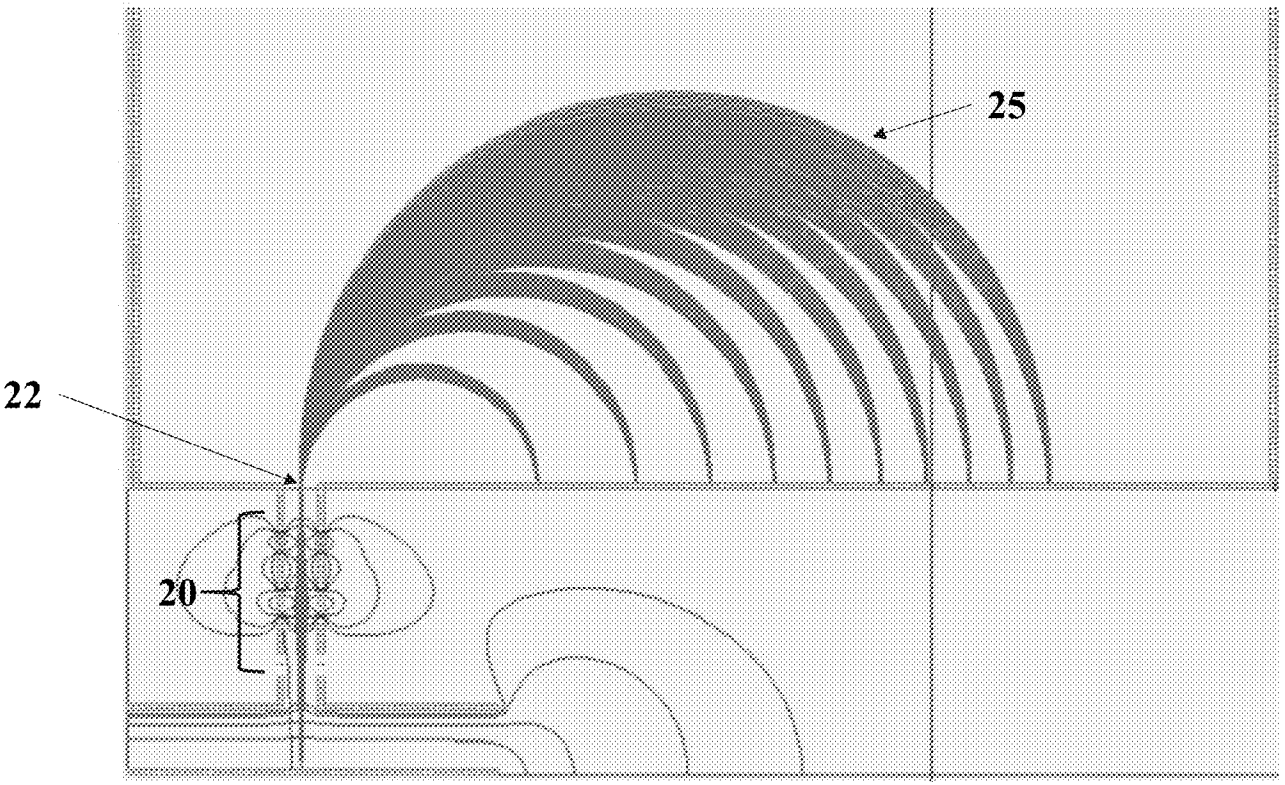
FIG. 3 is a simulated trajectory of ions from 100 Da to 400 Da through magnetic sector.

The π-d magnetic analyzer is a system that has seen limited use since early MS days for a number of reasons. It has been generally presumed that such an analyzer could not focus ions at the detector, but with the LPMS described herein, it is shown that by incorporating an ion lens at the input of the analyzer, ions can be focused at the detector. In the exemplary embodiments discussed herein, ions have been given a +/−15 degree incident angle to mimic ions coming from a source region. Ions with different incoming angles at single masses will follow larger or smaller radii, but will meet at the detector at a focused point. Focusing at the detector is mass-independent, perhaps a surprising result, but a critical result for an arrayed detector. With this geometry, the ion packet width at the detector is the same size as the incoming ion packet. The ion transfer optics include ion focusing lenses to ensure the width at the entrance is focused to a point. Results for the ion trajectory simulation for 100-400 Da masses (in increments of 25 Da per step) are shown in FIG. 3 for a full turn magnetic analyzer. Ions start in the lower left corner, are sent through a series of lenses 20 which focus the ions at the point of injection 22 into the electric field-free, magnetic region 25. Ions are separated by mass-to-charge and hit the detector array (not shown) at the end of their trajectories. The 100 Da mass is closest to the ion source (smallest trajectory radius), and the 400 Da ions follow the outside trajectory. The design constraints include several factors but are tailored to the size of the detector array. The magnetic field strength is chosen so that passive magnets can easily be used, the radius is chosen based on the desired mass range and detector size, and the ion injection energy sets the overall radius. Unlike a Mattauch-Herzog geometry, a wider mass range is achievable in a smaller volume. Negative ions will be generated in a mirror image configuration and switched in this architecture.

In a fielded system, magnetic shielding may be necessary to limit stray field emissions and susceptibility to external magnetic field. We anticipate some drift in the magnetic field with changing temperature. This could be compensated by deriving temperature-dependent calibration coefficients for the system, coupled with a temperature sensor, or through the use of an internal chemical standard or external calibration mass to recalibrate the system during operation.

Pump power consumption specifications are derived from analyzing the working subsystems, internal documents, personal communications, and extrapolation of technical data of single stage pumps to a multistage rough pump. Because of the short ion flight path, pressures from $10^{-3}$ to $10^{-4}$ Torr will yield collision-free ion flight paths, and these pressures are readily accessible with an ion streaming pump backed by a MEMS diaphragm pump. The pump is the primary power contributor to the LPMS, but it is expected that in the present embodiments, the MEMS pump will operate at well under a watt.

To further minimize power consumption, DC fields are used wherever possible and switch potentials at low frequency. Ideally, system voltages need only be changed when going to a high-resolution mode to compensate for the limited pixel resolution of the detector. The position of the LPMS's detector affects the ultimate lower limit to the system's upper mass range. For example, in a 2 Da to 500 Da mass range and the inverse squared relationship with mass-to-charge versus detector position, the higher mass items will have tighter pixel spacing. We anticipate a resolution (based on modelling) of 700 (mass/delta mass at FWHM). To account for the tighter pixel spacing, a lower injection voltage will move the higher mass beam closer to the detector and spread out the beam, leading to higher resolution for high mass items.

The magnetic field geometry required for ion separation is a gap construction. This configuration has considerably lower stray fields compared to a Halbach or a toroidal geometry. The use of two N-S magnets is sufficient to create the magnetic field. A surrounding "c-clamp" of permeable material provides support and completes the magnetic circuit while minimizing stray fields. The prior art reports a magnetic field strength of 0.75 T at 0.5 cm gap width, 6 using common neodymium magnets. Permanent magnets in both gapped and Halbach configuration of 1.0 Tesla are available. The prior art reports field strengths in excess of 5 Tesla have been demonstrated. Other rare earth permanent magnets which may be used include samarium-cobalt (SmCo) magnets. Our exemplary magnet is a magnetic circuit comprised of two permanent magnets composed of neodymium iron boron material bonded to a fixed yoke. The magnetic field strength is 0.8 Tesla as measured using a magnetic field strength meter (AlphaLab DC Gaussmeter Model GM2).

Figure 4:
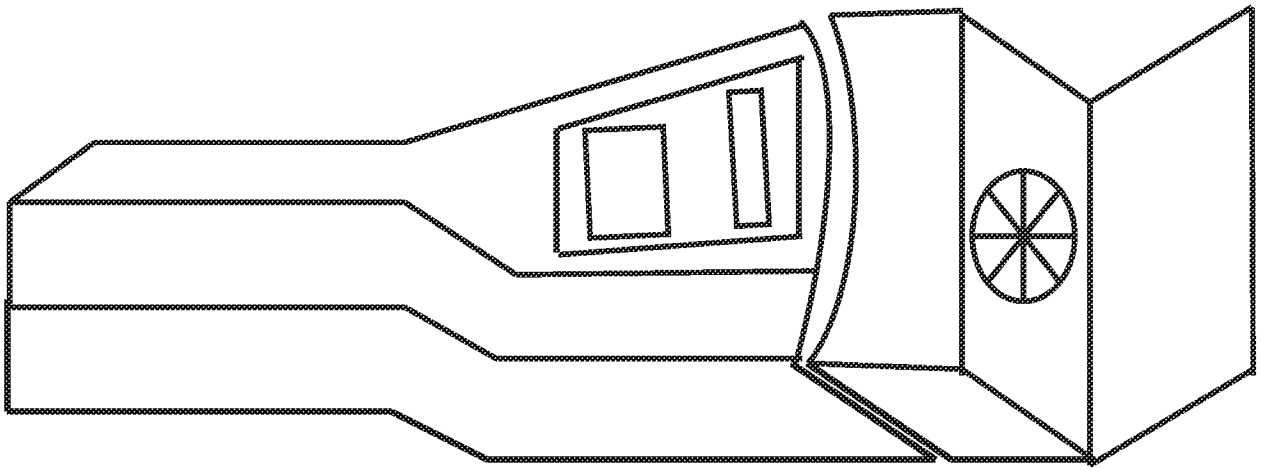
FIG. 4 is a conceptual rendering of the embodied handheld device.

FIG. 4 illustrates a mock-up of a proposed handheld device configuration with LPMS incorporated therein. In this embodiment, the device includes a modular front end and further consists of a directed vapor inlet with a modular thermal desorber for test and validation using standardized wipe swabs. While this approach may not be the most efficient in terms of power or operational efficiency, it facilitates comparisons to current detection technology, remains operationally relevant, and maintains expandability for future sampling developments. The modularity enables rapid testing of direct vapor (without the desorber) and surface wipe samples (with the desorber). Furthermore, the modularity provides a path for developing alternate front ends, which may include potential add-ons, such as a noncontact sampler (desorption electrospray ionization [DESI], direct analysis in real-time [DART]), liquid or solid direct sampler, or other hybrid or hyphenated approaches, such as an ion mobility (IM) or fast gas chromatography (GC) front end. For example, some interferents may not be distinguishable from explosives with IMS or MS (LPMS) alone, but are distinguishable with hybrid systems. The LPMS could also be implemented as a front-end module in an LPMS-MS or other hybrid system for ion pre-selection for a higher performance instrument.

The preferred embodiments enable an instrument with the performance (<0.1 amu at mass-to-charge ratios [m/z] 250) of a laboratory mass spectrometer in a handheld form factor. Power consumption is significantly reduced over conventional systems, with an anticipated power consumption of the entire system of less than 1.2 W. It is estimated that with a 36 Ah battery, the system will run for 30 hours while the weight (with battery) is projected to be less than five pounds. Power consumption is affected with readout speed and efficiency of the detector and pumping system, these values would be expected to be typical for an optimized system. Though overall size will vary in accordance with detector footprint and other physical components, the largest single dimension of an LPMS embodied herein is less than 12 inches.

By way of example only, at least the following threats and obscurants listed in Table 2 below may be included in the device database of target spectra and may be identified by devices and systems which incorporate an LPMS. Table 2 contains 30 explosives, 17 drugs, 7 precursors, and more than 30 interferents. In the tables below, [X]=explosive or taggant, [I]=interferent, [P]=precursor, and [S]=solvent.

TABLE 2

| Nitrated Explosives and Taggants, Salt and Homemade Precursors | Drugs and Narcotics | Interferents, Obscurants |
|---|---|---|
| Octahydro-1,3,5,7-tetranitro-1,3,5,7-tetraazocine (HMX) [X] | Cocaine diamine (HMTD) [X] | Windex [I] |
| Hexahyrdro-1,3,5-trinitro-1,3,5-triazene (RDX) [X] | Heroine [X] | Aqueous fire-fighting foam (AFFF) [I] |
| 1,3,5-trinitrobenzene (TNB) [X] | L-amph (Carbamite) [X] | Chanel No. 5 [I] |
| dinitrobenzene (DNB) [X] | Methamphetamine | Polo cologne [I] |
| methyl-2,4,6-trinitrophenyl nitramine (Tetryl) [X] | MDA (ANFO) [X] | Skoal chewing tobacco |
| 4/2-amino-dinitrotoluene (DNT) [X] | THC | Crest white strips [I] |
| nitrobenzene (NB) [X] | ketamine (MEKP) [X] | Tide detergent [I] |
| 2,3-dimethyl-2,3-dinitrobutane (DMDNB) [X] | LSD | Oxi clean [I] |
| nitroglycerine (NG) [X] | MDMA | Swiffer Cleaning Pad [I] |
| Pentaerythritol tetranitrate (PETN) [X] | Morphine | Febreze odor reducer [I] |
| 2,4,6-trinitrotoluene (TNT) [X] | PCP | Bounce dryer sheet [I] |
| 2,6-dinitrotoluene; 2,4-dinitrotoluene (DNT) [X] | Spice | Coffee, ground [I] |
| Semtex A [X] | Hydromorphone | Pipe tobacco [I] |
| Semtex B [X] | Meperidine | Crest toothpaste [I] |
| C-4 [X] | Dexedrine | Musk ketone [I] |
| Potassium chlorate (PC) [X] | Fentanyl | Musk ambrette [I] |
| Methyl nitrate [X] | Oxycodone | Musk xylene [I] |
| hexamethylene triperoxide | | Toluene [S, P, I] |
| triacetone triperoxide (TATP) | | Methanol [S, P, I] |
| 1,3-diethyl-1,3-diphenylurea | | Methylene chloride [S, I] |
| ammonium nitrate (AN) [P] | | Methyl ethyl ketone (MEK) [S, P, I] |
| ammonium nitrate/fuel oil | | Isopropyl alcohol (IPA) [S, I] |
| Urea nitrate [X] | | nitric acid [P, I] |
| methylethylketone-peroxide | | Ethanol [S, I] |
| Mobil 1 SAE 10W-30 [P, I] | | Sterno Fuel [P, I] |
| 2,4,6-Trinitrophenylmethylnitramine (Tetryl) [X] | | Tetrahydrofuran (THF) [S, P, I] |
| hydrogen peroxide [P, I] | | Phenol [P, I] |
| acetone [S, P, I] | | Sulfuric acid [P, I] |
| nitromethane [X] | | Hexamine [P, I] |
| Lead picrate [X] | | Parathion [I] |
| Picric acid [X] | | Malathion [I] |
| Ammonium picrate [X] | | Cyfluthrin [I] |
| Potassium chlorate (PC) [X] | | Imidacloprid [I] |
| Sodium chlorate [X, P] | | Clorox Bleach [I] |

The LPMS may also be incorporated as part of a more complex system for chemical material detection and identification. Such systems are needed for applications such as forensic analysis, border and facility protection, and stockpile and production monitoring. In particular, a need has been identified for local and continuous monitoring of the chemical environment in remote site areas over long periods of time without human oversight. As described in the Broad Area Announcement released in by Intelligence Advanced Research Projects Activity (IARPA) in 2016, and ideal system would provide the ability to identify the constituents of a complex chemical mixture with laboratory-quality sensitivity and accuracy. Further, the ideal system would have the capability to run autonomously for long-term operations and withstand rugged and potentially harsh environmental conditions. Other preferred features of the ultra-low-power chemical analysis system include detection and identification of explosives, chemical weapons, industrial toxins and pollutants, narcotics, and nuclear materials in the presence of significant background and interferents. The features of the LPMS described in herein make it an ideal candidate for inclusion as part of the needed system.

One skilled in the art will recognize that the present embodiments are not limited to the specifics of any particular exemplary embodiment. Various alternative aspects of the embodiments are not explicitly recited or listed herein, but are clearly within the expertise of one skilled in the art. Such foreseeable and known variations are believed to be within the scope of the present embodiments.

The skill in the art is exemplified in the following documents, the substance of which is incorporated herein by reference: J. P. Hauschild, et al., "Mass Spectra Measured by a Fully Integrated MEMS Mass Spectrometer," International Journal of Mass Spectrometry, 264, pp. 53-60, 2007; "Focus on Field-Portable and Miniature Mass Spectrometers," Presentations From the 12$^{th}$ Sanibel Conference on Mass Spectrometry, J. Am. Soc. Mass Spectrom., 12, pp. 617-618, 2001; Mo Yang, et al., "Development of a Palm Portable Mass Spectrometer," J. Am. Soc. Mass Spectrom., 19, pp. 1442-1448, 2008; J. Mitchell Wells, et al., "Implementation of DART and DESI Ionization on a Fieldable Mass Spectrometer," J. Am. Soc. Mass Spectrom., 19, pp. 1419-1424, 2008; Jorge Andres Diaz, et al., "Test of a Miniature Double-Focusing Mass Spectrometer For Real-Time Plasma Monitoring," Trends in Analytical Chemistry, Vol. 21, No. 8, pp. 515-525, 2002; Guangming Huang, et al., "Direct Detection of Benzene, Toluene, and Ethylbenzene at Trace Levels in Ambient Air by Atmospheric Pressure Chemical Ionization Using a Handheld Mass Spectrometer," J. Am. Soc. Mass Spectrom., 21, pp. 132-135, 2010; Gregory D. Schilling, "Detection of Positive and Negative Ions From a Flowing Atmospheric Pressure Afterglow Using a Mattauch-Herzog Mass Spectrograph Equipped With a Faraday-Strip Array Detector," J. Am. Soc. Mass Spectrom., 21, pp. 97-103, 2010; David A. Solyom, et al., "Simultaneous or Scanning Data Acquisition? A Theoretical Comparison Relevant to Inductively Coupled Plasma Sector-Field Mass Spectrometers," J. Am. Soc. Mass Spectrom., 14, pp. 227-235, 2003; Jesse A. Contreras, et al., "Hand-Portable Gas Chromatograph-Toroidal Ion Tap Mass Spectrometer (GC-TMS) For Detection of Hazardous Compounds," J. Am. Soc. Mass Spectrom., 19, pp. 1425-1434, 2008; U.S. Pat. No. 7,402,799 (Friedhoff), issued Jul. 22, 2008, titled "MEMS Mass Spectrometer"; U.S. Pat. No. 7,649,171 (Friedhoff), issued Jan. 19, 2010, titled "Miniature Mass Spectrometer For the Analysis of Biological Small Molecules"; Li Ding, et al., "A Simulation Study of the Digital Ion Trap Mass Spectrometer," International Journal of Mass Spectrometry, 221, pp. 117-138, 2002; Jorge Andres Diaz, et al., "Integration Test of a Miniature ExB Mass Spectrometer With a Gas Chromatograph For Development of a Low-Cost, Portable, Chemical-Detection System, Trends in Analytical Chemistry," Vol. 23, No. 4, pp. 314-321, 2004; Timothy P. Griffin, et al., "Three-Dimensional Concentration Mapping of Gases Using a Portable Mass Spectrometer System," J. Am. Soc. Mass Spectrom., 19, pp. 1411-1418, 2008; Barnes, J. H., et al., "Recent advances in detector-array technology for mass spectrometry" Int. J. Mass Spectrom., 238 (2004), 33-46; and Peter T. Palmer, et al., "Mass Spectrometry in the U.S. Space Program: Past, Present, and Future," J. Am. Soc. Mass Spectrom., 12, pp. 656-675, 2001.

The invention claimed is:

1. A handheld low power mass spectrometer for facilitating analysis of a sample's chemical contents comprising:

an ion focusing component for focusing a sample ion beam containing sample ions to a focal point;

a magnet assembly located at an output of the ion focusing component for creating a permanent magnetic field region beginning at the focal point of the ion focusing component for deflecting the focused sample ions using zero power, wherein the sample ions contain ions having a range of masses from 100 to 400 Da; and a linear detector array for simultaneously detecting the deflected sample ions, wherein the linear detector array has a length equal to or less than 5.1 cm and a width equal to or less than 1.5 mm and lies in the same plane as the focal point of the ion focusing component and further wherein individual sample ions are deflected 180 degrees from the focal point to different points along the linear detector array in accordance with an individual mass thereof;

wherein the low power mass spectrometer has a physical footprint equal to or less than 30.48 cm at its largest length.

2. The low power mass spectrometer of claim 1, further comprising an electrostatic energy filter.

3. The low power mass spectrometer of claim 1, wherein the magnet assembly consists of first and second magnets connected to a surrounding yoke.

4. The low power mass spectrometer of claim 3, wherein the magnet assembly generates an approximately 1 Tesla static magnetic field.

5. The low power mass spectrometer of claim 1, wherein the low power mass spectrometer requires less than 1.2 watts of power during operation.

6. The low power mass spectrometer of claim 1, wherein the linear detector array is an ion CCD detector.

7. The low power mass spectrometer of claim 1, further comprising at least one vacuum pump.

8. The lower power mass spectrometer of claim 7, wherein the at least one pump is a micro electro mechanical systems (MEMS) pump.

9. A handheld zero-power mass analyzer for facilitating analysis of a sample's chemical contents comprising:

a magnet assembly located at an output of an ion focusing component for creating a permanent magnetic field region beginning at a focal point of the ion focusing component for deflecting focused sample ions using zero power to a linear detector has a length equal to or less than 5.1 cm and a width equal to or less than 1.5 mm, wherein individual sample ions are deflected 180 degrees from the focal point to different points along the linear detector in accordance with an individual mass thereof in a range of 100 to 400 Da and simultaneously detected thereby;

wherein the zero-power mass analyzer has a physical footprint equal to or less than 30.48 cm at its largest length.

10. The zero-power mass analyzer according to claim 9, wherein the first and second magnets are comprised of neodymium iron boron material.

11. The zero-power mass analyzer according to claim 9, wherein the magnet assembly generates an approximately 1 Tesla static magnetic field.

12. A handheld low power mass spectrometer for facilitating analysis of a sample's chemical contents comprising:

an ionization source for ionizing the sample to form an ion beam containing sample ions;

an ion focusing component for focusing the sample ion beam to a focal point;

a permanent magnetic field region located at an output of the ion focusing component and beginning at the focal point of the ion focusing component for deflecting the focused sample ions, wherein the sample ions contain ions having a range of masses from 100 to 400 Da;

at least one micro electro mechanical systems (MEMS) vacuum pump for maintaining a predetermined vacuum pressure in the permanent magnetic field region; and a linear detector array for simultaneously detecting the deflected sample ions, wherein the linear detector array has a length equal to or less than 5.1 cm and a width equal to or less than 1.5 mm and lies in the same plane as the focal point of the ion focusing component and further wherein individual sample ions are deflected 180 degrees from the focal point to different points along the linear detector array in accordance with an individual mass thereof;

wherein the low power mass spectrometer has a physical footprint equal to or less than 30.48 cm at its largest length.

13. The zero-power mass spectrometer of claim 12, wherein the permanent magnetic field region consists of first and second magnets connected to a surrounding yoke.

14. The low power mass spectrometer of claim 13, further comprising an electrostatic energy filter.

15. The low power mass spectrometer of claim 14, wherein the linear detector array is an ion CCD detector.

16. The low power mass spectrometer of claim 12, wherein the magnet assembly generates an approximately 1 Tesla static magnetic field.

17. The low power mass spectrometer of claim 12, wherein the low power mass spectrometer requires less than 1.2 watts of power during operation.

* * * * *